US006186108B1

(12) United States Patent
Takahashi et al.

(10) Patent No.: US 6,186,108 B1
(45) Date of Patent: Feb. 13, 2001

(54) IGNITION ARRANGEMENT FOR ENGINE

(75) Inventors: Masanori Takahashi; Kazuhiro Nakamura, both of Hamamatsu (JP)

(73) Assignee: Sanshin Kogyo Kabushiki Kaisha, Hamamatsu (JP)

( * ) Notice: Under 35 U.S.C. 154(b), the term of this patent shall be extended for 0 days.

(21) Appl. No.: 08/979,073

(22) Filed: Nov. 26, 1997

(30) Foreign Application Priority Data

Nov. 27, 1996 (JP) ..... 8-316008

(51) Int. Cl.[7] ..... F02P 1/00
(52) U.S. Cl. ..... 123/149 D; 123/406.57
(58) Field of Search ..... 123/149 D, 406.57

(56) References Cited

U.S. PATENT DOCUMENTS 3,828,754 * 8/1974 Carlsson ..... 123/149 D
4,160,435 * 7/1979 Sleder ..... 123/149 D
4,344,391 8/1982 Mizutani et al. .
4,721,485 1/1988 Suzuki .
4,901,704 * 2/1990 Safranek ..... 123/149 D
5,078,101 * 1/1992 Anderson et al. ..... 123/149 D
5,159,916 11/1992 Isogawa .
5,370,563 12/1994 Yamazaki et al. .
5,524,597 6/1996 Hiki et al. .

* cited by examiner

*Primary Examiner*—John Kwon
(74) *Attorney, Agent, or Firm*—Knobbe, Martens, Olson & Bear LLP

(57) ABSTRACT

An ignition arrangement is provided for an internal combustion engine having an output shaft supported for rotation about an axis. The engine has a housing at least partially enclosing the output shaft and including at least one face. The output shaft has a portion extending through the one face of the engine housing and surrounded by the face. A timing pulley is affixed for rotation with the output shaft. A camshaft is supported for rotation about a second axis. A drive connects the timing pulley to the camshaft whereby the output shaft drives the camshaft. A flywheel is affixed for rotation with the output shaft wherein the timing pulley is closer to the face than the flywheel. A first ignition element is affixed for rotation with the timing pulley, and a pulser coil being in cooperation with the first ignition means.

21 Claims, 5 Drawing Sheets

IGNITION ARRANGEMENT FOR ENGINE

BACKGROUND OF THE INVENTION

This invention relates to an ignition timing control arrangement for an outboard motor with an internal combustion engine and more particularly to an improved arrangement for mounting the ignition system.

It is well known in connection with certain types of engines to provide a flywheel magneto in which the flywheel carries a plurality of rotating magnets and which cooperates with a charging coil and a pulser coil for charging and firing an ignition circuit. In accordance with such arrangements, it is frequently the practice to mount the pulser coil on a plate that so that it can detect and signal the position of the crankshaft in order for proper timing of the ignition of the engine.

Also, with four cycle engines is it well known in the art to mount the timing pulley or gear on the output shaft adjacent to the flywheel. The timing pulley rotates with the output shaft and subsequently drives a belt or a chain which in turn drives a cam shaft assembly thereby controlling the intake and exhaust valves for the cylinders of the engine. As shown in the prior art in FIG. 6 it is conventional to mount the flywheel on the outermost portion of the output shaft. It is also conventional to mount the timing pulley on the output shaft between the flywheel and the engine.

As shown in the prior art the pulser coil is located in a recessed area near the outer diameter of the flywheel. This type of configuration is utilized to minimize the overall height of the engine. As is well known, minimizing the height of the engine is desirable in order to minimize the exterior cowling thereby lowering the aerodynamic drag on the associated watercraft.

In order to achieve a lower engine height it is well known in the art to locate the pulser coil in recessed area of the flywheel. A major disadvantage of this type of configuration, however, is that by locating the pulser coil in the flywheel the center of gravity of the flywheel is shifted away from the face of the engine where the output shaft is supported for rotation. By locating the center of gravity on the outside of the shaft the effect of an imbalance in the flywheel is magnified. This imbalance can cause the pulser coil signal improperly thereby causing a misfiring of the engine. Or, in the case of extreme imbalance, the output shaft could plastically deform thereby causing damage to the engine.

Yet another aggravating factor is that the angle of the motor can be changed during the normal tilt and trim operation of the motor. This has the effect of causing greater imbalance when the motor is operated through the full tilt and trim range.

It is therefore, a principal object of this invention to provide an improved mounting arrangement for the ignition system of the engine. More specifically it is an object of the invention to provide an arrangement of the ignition system of the engine that will insure accuracy in the timing of the engine regardless of the changes in the angle of the output shaft.

It is a further object of this invention to provide a mounting structure that for the ignition system of the engine to facilitate a system that will minimize the possibility of flywheel imbalance.

It is a yet another object of the invention to provide a mounting structure that will increase the reliability of the ignition of the engine.

It is still a further object of the invention to provide a structure that improves the durability of the engine.

SUMMARY OF THE INVENTION

The present invention is an ignition arrangement for an internal combustion engine. The internal combustion engine has an output shaft supported for rotation about an axis, an engine housing at least partially enclosing the output shaft. The engine housing includes at least one face and the output shaft has a portion extending through the one face of the engine housing and surrounded by the face. A timing pulley is affixed for rotation with the output shaft. A camshaft is supported for rotation about a second axis and drive means connect the timing pulley to the camshaft whereby the output shaft drives the camshaft. A flywheel affixed for rotation with the output shaft wherein the timing pulley is closer to the face than the flywheel. A first ignition means is affixed for rotation with the timing pulley, and a pulser coil being in cooperation with the first ignition means.

DETAILED DESCRIPTION OF THE PREFERRED EMBODIMENTS OF THE INVENTION

Figure 1:
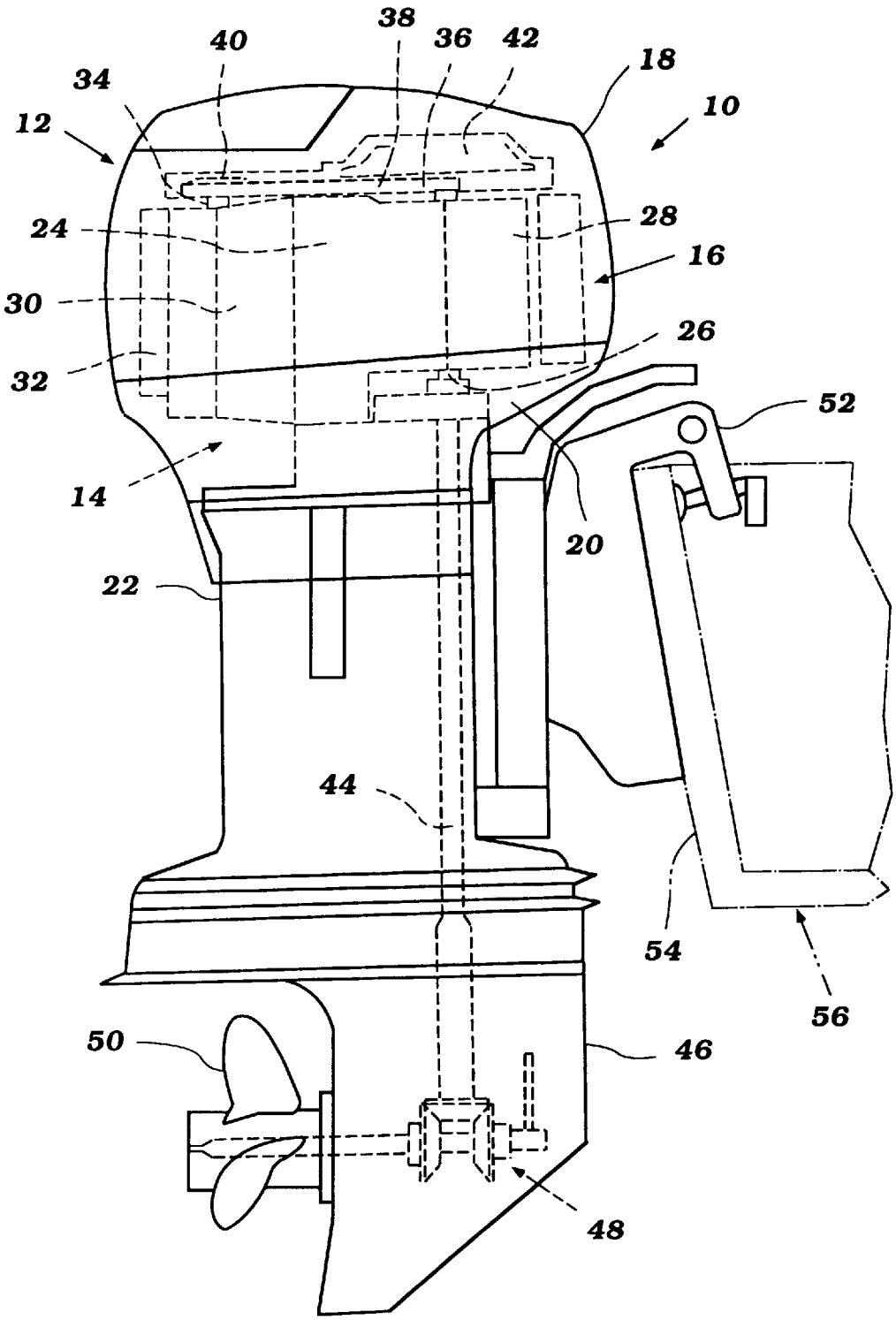
FIG. 1 is a side elevational view of an outboard motor, with some parts shown in phantom, and a partial view of an associated watercraft having an ignition system constructed in accordance with an embodiment of the invention.

Referring now in detail to the drawing and first to the embodiment of FIG. 1, an outboard motor is constructed in accordance with this embodiment and is identified generally by the reference numeral 10. The outboard motor 10 is generally comprised of a powerhead 12. The powerhead 12 is comprised of a powering internal combustion engine generally referenced by the number 14. In this embodiment the engine 14 is a four cycle engine. As will become apparent by description of the remaining embodiment the invention is not limited to the number of cylinders employed or the cylinder orientation. In addition, the invention is not limited to reciprocating engines or engines operating on the two stroke crankcase compression principal. Because, the invention particularly relates to four cycle engines this type of embodiment is depicted.

In addition to the engine 14, the powerhead 12 is comprised of a protective cowling arrangement referenced generally by the numeral 16. The cowling arrangement 16 is divided into an upper portion 18 and a lower portion 20. The upper cowling portion 18 which has a generally has an inverted cup shape and which is typically formed from a molded fiberglass reinforced resin is detachably connected to the lower cowling portion 20 by means such as a latch assembly as known in the art. The latch assembly, not shown, facilitates the removal of the upper cowling portion 18 for servicing of the engine 14.

The cowling 16 generally surrounds and protects the engine 14 from the environment. The engine 14 is typically mounted on tray which is not shown. The tray is typically formed from rigid material such as aluminum or a molded fiberglass resin. The tray is typically affixed to the upper end of the drive shaft housing 22.

This embodiment depicts a four-cycle engine rather than a two-cycle engine. This invention, however, would still provide an improved ignition mounting arrangement for all types of configurations including, inline, V configurations or for rotary engines. The engine 14 includes a cylinder block 24 in which one or more cylinders are disposed. A crankshaft or output shaft 26 is supported for rotation at the lower end of the cylinder block 24 within a crankcase chamber 28.

A cylinder head assembly 30 is affixed to the cylinder block 24 and closes its respective cylinder bores. A head cover 32 is affixed to the cylinder head 30 to completely close off the internal workings of the valve mechanism which control the intake and the exhaust of the cylinders as is known in the art.

In this embodiment the engine 14 has a single cam configuration. The camshaft 34 is supported for rotation about a generally vertical axis parallel to the axis of rotation of the crankshaft 26. The camshaft 34 is mounted for rotation in the cylinder head 30 and is driven by drive means connected to the timing pulley 36. The drive means as shown in the embodiment are a timing pulley 36 and a toothed belt 38 driving a camshaft pulley 40 as is well known in the art. The camshaft pulley 40 is affixed to the camshaft 34 to impart the rotation from the belt 38. Alternative drive means could include driving the camshaft 34 with a chain and gear arrangement if the design incorporated a gear and chain configuration. With either embodiment, an idler tensioner pulley could be provided for maintaining the desired tension on the driving means, however, a tensioner mechanism is not shown in the current embodiment.

As for the ignition components, it is well known in connection with certain types of engines to provide a flywheel magneto in which the flywheel 42 contains a plurality of rotating magnets which cooperates with a charging coil and a pulser coil for charging the and firing an ignition. Because the operation of these parts is known in the art they will not be further described. The mounting of these components, however, will be discussed later.

As mentioned previously the engine 14 has crankshaft or output shaft 26 which is generally vertically disposed which, in turn, drives a drive shaft 44 that extends through a drive shaft housing 22 and into a lower unit 46. The current embodiments depicts a configuration where the drive shaft housing 22 and lower unit 46 are two distinct pieces, however, it is understood that the drive shaft housing can be formed integrally with the lower unit. The drive shaft 44 communicates with a suitable forward/neutral/reverse transmission which in turn drives the propulsion means 48. The propulsion means can include a waterjet propulsion system or, as shown in the current embodiment, a propeller 50.

Still referring to FIG. 1 most conventional outboard motor constructions employ a clamping bracket 52 that is adapted to be affixed in a suitable manner to the transom 54 of the associated watercraft 56 and which pivotally supports a swivel bracket for tilt and trim movements. The swivel bracket, in turn, journals a steering shaft for steering movement about a generally vertically extending steering axis when the swivel bracket is tilted down. The steering shaft, in turn, is resiliently connected to the drive shaft housing so as to support the remaining components of the outboard motor on the clamping bracket 52. The resilient support is employed for reducing the transmission of vibration from the operation of the propulsion unit, including the powering internal combustion engine, to the hull.

Figure 2:
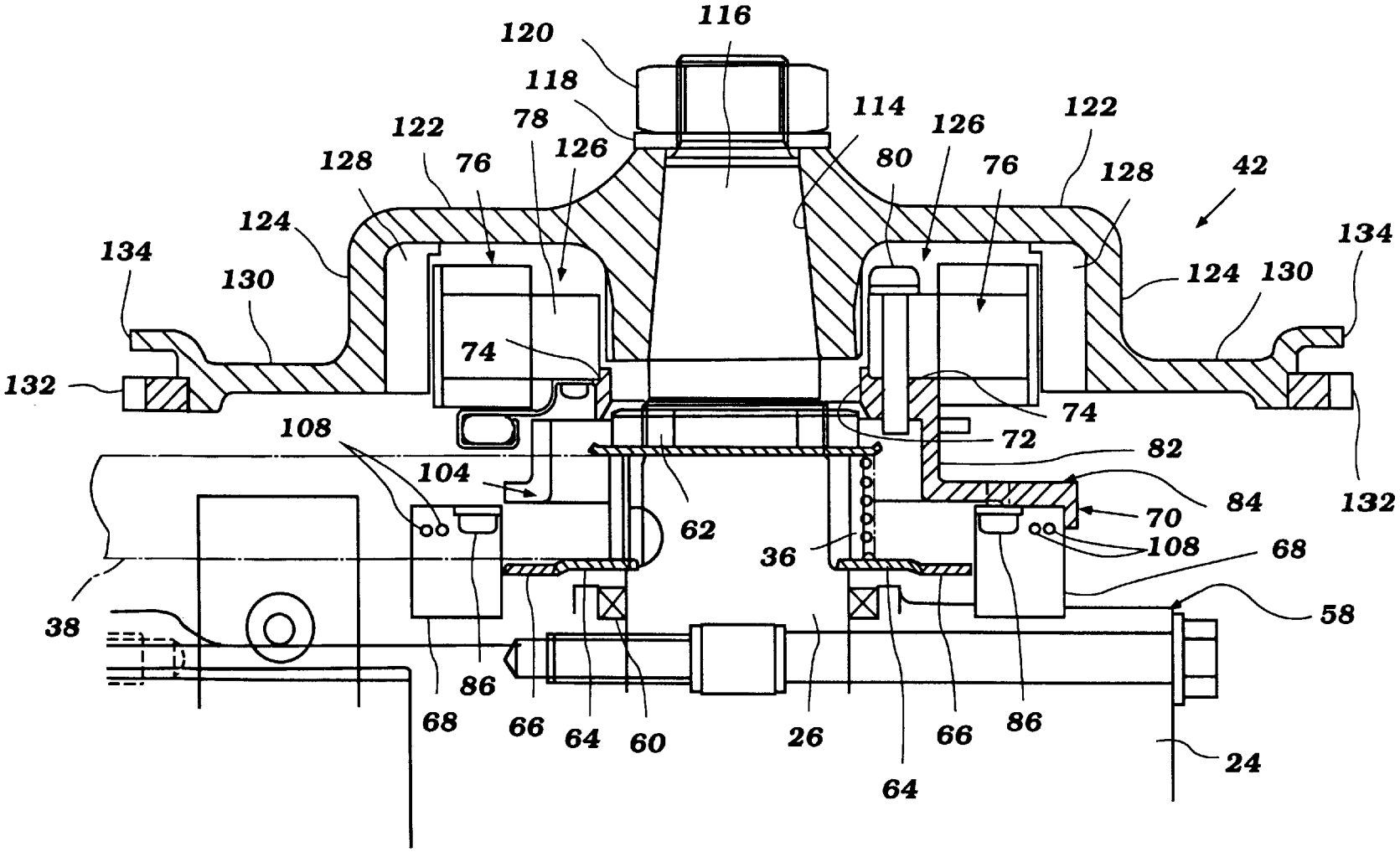
FIG. 2 is a partial cross-sectional view of the flywheel and timing pulley showing the arrangement of the ignition system of an embodiment of the invention.

Up to this point the description of the invention is typical, the arrangement of the ignition components will now be described. Referring now primarily to FIG. 2 the crankshaft 26 is partially enclosed in an engine housing and is supported for rotation about a generally vertical axis. The portion of the engine 14 typically housing the output shaft 26 is the cylinder block 24 and the crankcase member 28. The output shaft 26 extends through the upper face 58 of the engine housing. The upper face 58 further surrounds the output shaft and provides a boss in which an anti-friction bearing 60 is located. The bearing 60 partially journals and supports the output shaft 26 for rotation.

The timing pulley 36 is affixed for rotation with the output shaft 26 by way of a key and groove arrangement as is known in the art. Further, the timing pulley is held in location to output shaft by a retaining nut 62. The retaining nut 62 is typically threaded and mates with a corresponding threaded portion on the output shaft. The timing pulley 36 has two sides, a generally bottom side being located adjacent to the face 58 of the engine and a generally top side being located farther away from the face 58 and adjacent to the flywheel 42. The bottom side of a the timing pulley 36 terminates in a flange 64 extending radially outward from the center of the timing pulley 64. Further extending off of the bottom flange 64 are plurality of pick ups 66 for the pulser coil 68. The pick ups 66 are only the illustrated embodiment of the ignition means of the invention. Other ignition means affixed for rotation with the timing pulley and being in cooperation with the pulser coil 68 could be substituted for the pick-up as illustrated. The pick ups 66 also extends radially outward from the center of the timing pulley 36 and communicate, upon rotation of the timing pulley 36, with pulser coil 68. As is shown in FIG. 2 the timing pulley 36 is in fact a pulley and therefore will typically drive a toothed belt 38 which in turn drives the camshaft 34.

Figure 3:
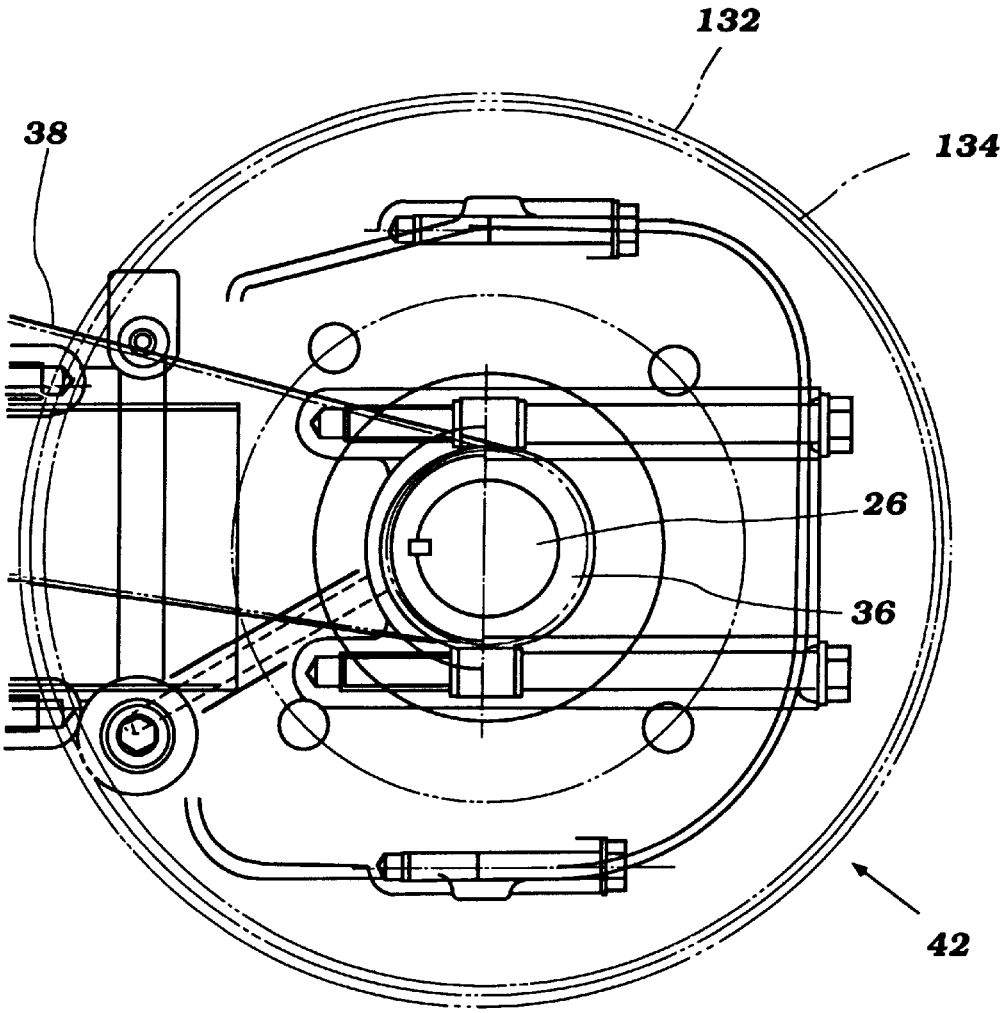
FIG. 3 is a partial plan view, with the timing pulley and the flywheel shown in phantom, of an embodiment of the ignition system of the invention.
Figure 5:
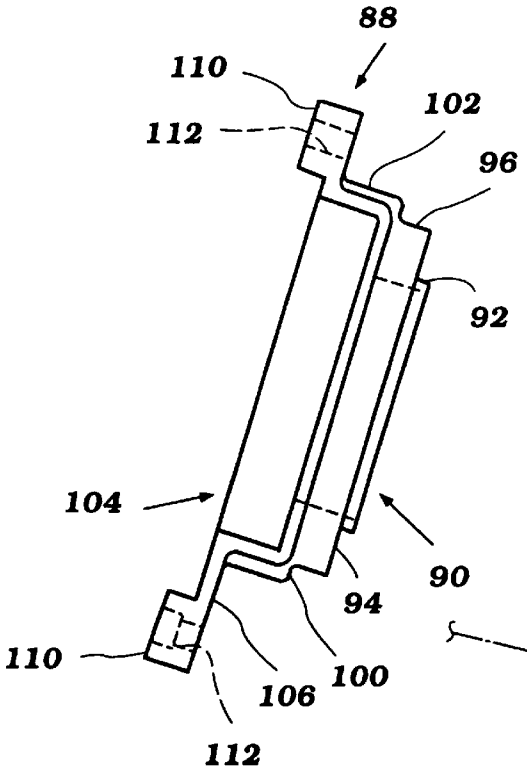
FIG. 5 is a cross sectional view of the mounting member of FIG. 4 taken generally along the line 5—5.
Figure 6:
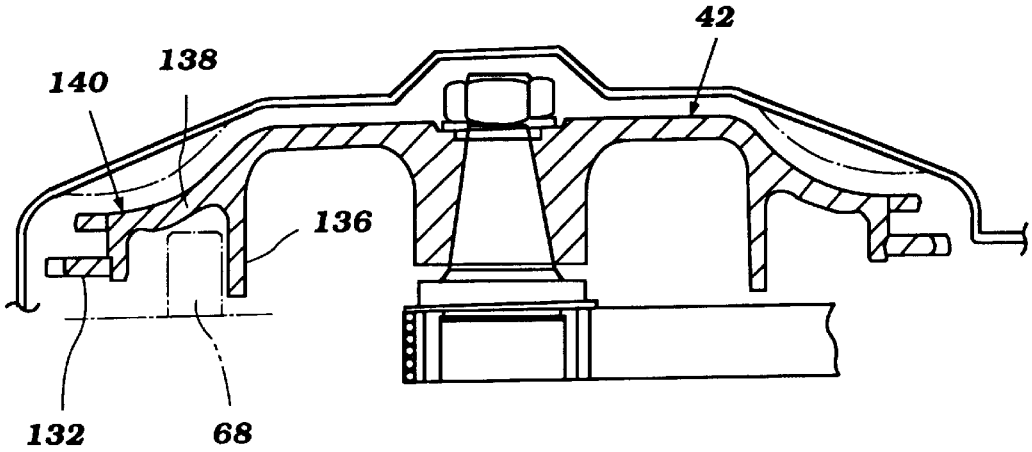
FIG. 6 is a partial cross sectional view of the ignition arrangement constructed in accordance with the prior art of the invention.

Extending further upward from the face 58 is located a rigid mounting member 70. One embodiment of the rigid mounting member is shown FIG. 2 and FIG. 3 while another embodiment is shown in FIG. 5 and FIG. 6. Referring first to rigid mounting member as shown in FIG. 2 and FIG. 3 it shown that the mounting member 70 contains a circular hole 72 surrounding the output shaft 26. The mounting member 70 also contains a generally top side 74 being located approximately adjacent to the flywheel 42 and a generally bottom side which is located adjacent to the face 58 of the engine. In between the top and bottom portions of the mounting member 70 lie several tiers to which the differing parts of the ignition means are mounted.

The top portion 74 defines a relatively horizontal surface to which mounting holes are provided for the mounting of the charging coil. In this embodiment the charging coil 76 is a attached to a mounting ring 78 which contains through holes. Mechanical fasteners 80 are placed through the through holes and into mating holes in the top portion 74. In this embodiment the mechanical fasteners 80 are threaded screws and the holes of mounting member 70 are internally treaded to accept the screws.

At the radially outermost portion of the top horizontal portion 74 of the mounting member 70 is a generally downward turned portion 82. This downward turned portion 82 extends, partly covering and encasing the timing pulley 36 to its termination at a second generally horizontal face 84. This second generally horizontal face 84 extends radially outward of the downward turned flange and provides a mounting area for the pulser coil 68. The mounting area 84 includes threaded holes in which to receive threaded screws 86 in order to mount the pulser coil 68 in a side of the mounting member 70 adjacent to the face 58.

As is shown in FIG. 2 the downward flange 82 and second horizontal plane 84 only partially surround the timing pulley 36. The partial surrounding mounting member 70 allows adequate clearance for the timing belt 38 to pass through and thereby communicate with the camshaft assembly. As best illustrated in FIG. 2 and FIG. 3 the flywheel assembly 42 completely covers the two tiers of the mounting member 70. The mounting member 70 is secured to the face 58 with a plurality of mechanical fasteners. Further, the mounting member can be formed of a unitary piece or it can be formed of several pieces. An advantage of having the mounting member 70 be formed of several pieces is that it enhances the serviceability of ignition system.

Figure 4:
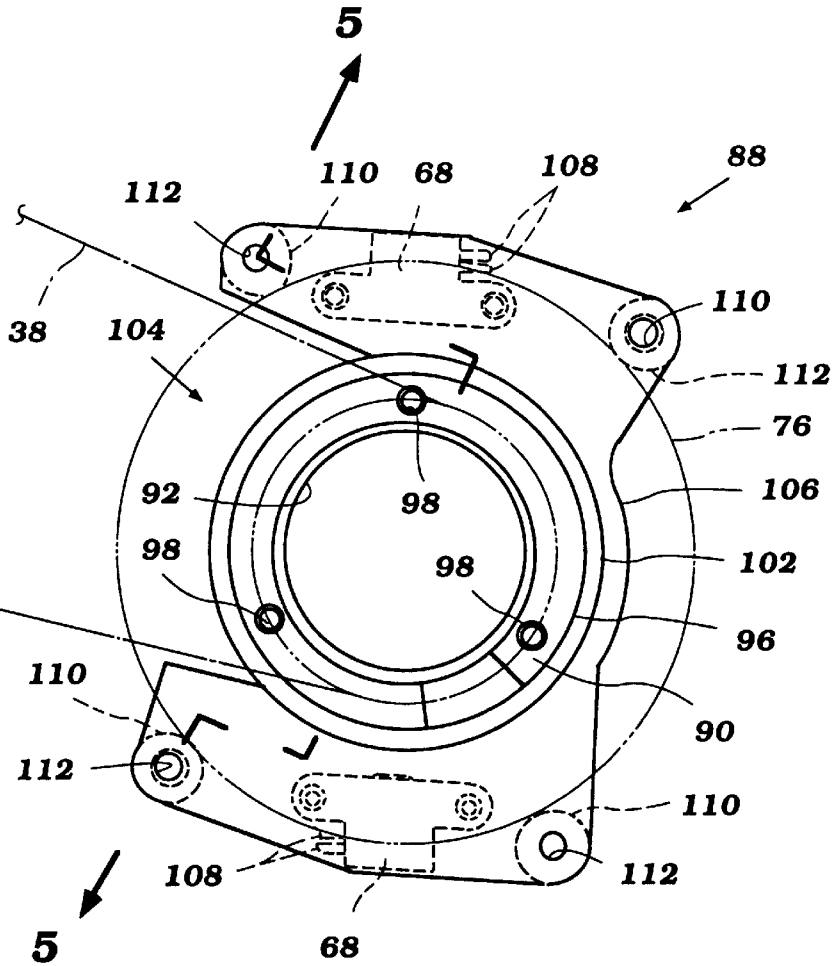
FIG. 4 is a partial plan view of a mounting member of another embodiment of the ignition system.

Another embodiment of the mounting plate assembly 88 is shown in FIG. 4 and FIG. 5. In this embodiment, the mounting member 88 has a top and bottom portion. The top portion 90 is adjacent to the flywheel 42 and the bottom portion lies adjacent to the face 58. In between the top and the bottom faces are several concentric cylindrical portions to which are mounted the various components of the ignition system. Starting from the top portion 90 of the mounting member 88 as best seen in FIG. 5 is shown a cylindrical collar 92 which at least partially surrounds the output shaft 26. The cylindrical collar 92 extends down an axis parallel to the axis of rotation of the output shaft 26 to a plane which defines a the top 94 of a second cylindrical member 96. The top plane 94 has a plurality of threaded mounting holes 98. These mounting holes 98 are aligned with holes on a mounting ring 78 on a charging coil 76.

Typically, the charging coil 76 is affixed to the mounting member 88 with mechanical fasteners such as a machine screws and the wires for the charging coil can be run through an access hole provided in the cylinder portion 96 and plane 94. When the charging coil 76 is mounted on the mounting member 88 the mounting ring 78 lies adjacent to the top surface 94 while the coils of the charging coil 76 lie adjacent to the outer radius of the cylinder 96. Further, the charging coil 76 is farther from the face 58 than the pulser coil 68.

The cylinder 96 then extends parallel to the axis of rotation of the output shaft 26 to a plane 100 which defines a top of a second cylinder 102. The second cylinder 102 is large enough to at least partially cover the timing pulley 36 arrangement. The second cylinder 102 contains an opening 104 for clearance of the timing belt 38 in order for the timing belt 38 to communicate with the camshaft assembly.

The second cylinder 102 extends towards the face 58 generally parallel to output shaft 26 and abuts a base plane 106. Plane 106 contains a plurality of mounting holes on the side adjacent to face 58 to mount the pulser coils. Thus, the pulser coil 68 is located closer to face 58 than the charging coil 76. Lead wires carry connect the pulser coil 68 to the ignition system as is known in the art.

The base 106 has a plurality of cylindrical mounting members 110 formed integrally each with a through hole 112. The mounting member 88 is removably attached to the face 58 of the engine 14 by placing mechanical fasteners through the holes and into mating holes on the face 58. Typically, a mechanical screw is inserted into the holes 112 and into an internally threaded mating hole in the face 58 of the engine 14.

Referring back to FIG. 2 the flywheel 42 contains a s tapered internal cavity 114 that fits to a corresponding tapered portion of the output shaft 116. The flywheel 42 is located so that the timing pulley 36 is located closer to the face 58 than the flywheel 42. A key way is provided in the output shaft 26 and in the flywheel 42 in order for the flywheel 42 to be affixed for rotation with the output shaft 26. The flywheel 42 is affixed to the output shaft 26 with a washer 118 and nut 120. The nut 120 mates with a corresponding threaded end of the output shaft 26 thereby affixing the flywheel 42 to the output shaft 26.

The shape of the flywheel 42 is best shown in FIG. 2. As stated previously the flywheel 42 includes a tapered hole 114 for mounting of the flywheel on the output shaft 26. Adjacent to the tapered hole 114 is a flange 122 extending radially from the portion of flywheel 42 nearest the output shaft. The flange 122 abuts a downward turned portion which 124 which forms an inner recessed area 126. The recessed area 126 extending radially from the center of the flywheel 42. A plurality of magnets 128 are located within the recessed area 126 and communicate with the charging coil 76. Portions of the charging coil 76 extend into the recessed area 126.

The recessed area 126 extends radially outward in and abuts a side of flange 124 and is in communication with the charging coil 76. The downward flange 124 abuts a radially extending flange extending outward 130. Unlike the prior art, where the pulser coil 68 is located in a second recessed area in the flywheel 42 the pulser coil 68 is located closer to the face 58 than the charging coil 76. Advantageously the downward flange 124 can follow a path generally parallel to the output shaft 26 thereby shifting the center of gravity of the flywheel 42 closer to the bearing 60 rotatably supporting the output shaft 26.

On the outermost radius of the flywheel 42 a ring gear 132 and weight ring 134 are mounted on a side of the flywheel nearest to the face 58 of the engine. The ring gear 132 is typically a toothed gear which communicates with a starter motor for electrically starting the engine 14 as is known in the art. The starter is not shown in the figures. The weight ring 134 provides rotational stability to the engine as is known in the art.

By locating the pulser coil 68 in communication with an ignition means affixed for rotation with timing pulley 36 there is no longer needed a space to house the pulser coil 68 in the flywheel 42 thereby allowing the shape the downward flange 124 to be shifted toward the face 58 of the engine housing. Thus the center of gravity of the flywheel is shifted toward the cylinder block 24. By having the center of gravity shifted toward the face 58 of the engine 14 the bearing 60 provides enhanced support for the rotating output shaft 36. For instance, the potential amplitude of the deformation caused by the vibration flywheel could be minimized because the vibrational forces will be acting on the output shaft at a location corresponding to the center of gravity of the flywheel.

This will result in the ignition system having better reliability as the coils and the pick ups will register all of the correct signals. Further, the minimization of the amplitude of the deformation will also minimize the potential for a potential plastic deformation of the shaft 26 which would decrease durability.

The mounting structure of the prior art is shown in FIG. 6. In this configuration, the pulser coil 68 is located within the flywheel 42 in a location between a generally downward flange 136 and a somewhat radially extending member 138.

The member 138 abuts a downward extending flange 140 on which the weight ring and ring gear are mounted. One reason for locating the pulser coil 68 in this configuration is to minimize the total vertical height of the engine assembly. As seen in the FIG. 6, by locating the pulser coil 68 in the flywheel a second recess is formed thereby moving the center of gravity of the flywheel 42 away from the face 58. This center of gravity of the flywheel of the prior art in FIG. 6 is thus farther away from the face 58 than of the current invention. Therefore, the crankshaft can vibrate and send erroneous pulse signals to the ignition. Further, flywheel imbalance in severe cases could cause crankshaft deformation thereby reducing the reliability of the engine.

Of course, the foregoing description is that of preferred embodiments of the invention, and various changes and modifications may be made without departing from the spirit and scope of the invention, as defined by the appended claims.

What is claimed is:

1. An ignition arrangement for an internal combustion engine having an engine housing, an output shaft supported for rotation about an axis by said engine housing, said engine housing at least partially enclosing said output shaft and including at least one face through which a portion of said output shaft extends and is surrounded, a timing pulley affixed for rotation with said portion of said output shaft, a camshaft supported for rotation about a second axis by said engine housing, drive means connecting said timing pulley to said camshaft in spaced relation to said one engine housing face, whereby said output shaft drives said camshaft, a flywheel having a flange portion affixed for rotation with said portion of said output shaft in spaced relation to said one engine body end face and a flywheel portion extending radially outwardly from said flange portion, said timing pulley lying closer to said one face than said flywheel, said ignition arrangement including an ignition signal generator comprised of a first ignition means affixed for rotation with said timing pulley at a point disposed radially inwardly of said flywheel and a pulser coil supported in a fixed axial location relative to said first ignition means by said engine housing and juxtaposed for cooperation with said first ignition means for effecting an electrical output upon relative rotation between said first ignition mean and said pulser coil.

2. An ignition arrangement of claim 1 wherein said flywheel flange portion forms a recessed area extending radially outwardly from the center of said flywheel and further including a charging coil juxtaposed to said flywheel.

3. An ignition arrangement of claim 2 wherein said charging coil extends generally into said recessed area of said flywheel flange portion.

4. An ignition arrangement of claim 3 further including at least one permanent magnet attached to and disposed within said recessed area of said flywheel flange portion and cooperating with said charging coil.

5. An ignition arrangement of claim 4 wherein said charging coil is farther from said face than said pulser coil.

6. An ignition arrangement of claim 2 wherein said flywheel further includes a weight ring and ring gear located on the outer-most radius of said flywheel and said weight ring and said ring gear are located substantially on a side of said flywheel nearest to said face of said engine housing.

7. An ignition arrangement of claim 2 further comprising at least one mounting member removably attached to said face of said engine housing at least partially encasing said timing pulley, and at least partially covered by said flywheel.

8. An ignition arrangement of claim 7 wherein said at least one mounting member further includes a mounting area for mounting said charging coil and a second mounting area for mounting said pulser coil.

9. An ignition arrangement of claim 1 wherein said internal combustion engine is surrounded by a protective cowling.

10. An ignition arrangement of claim 9 wherein said flywheel flange portion forms a recessed area extending radially outwardly from the center of said flywheel and further including a charging coil juxtaposed to said flywheel.

11. An ignition arrangement of claim 10 wherein said flywheel includes at least one permanent magnet attached within said recessed area of said flywheel.

12. An ignition arrangement of claim 11 wherein said charging coil is farther from said face than said pulser coil.

13. An ignition arrangement of claim 10 wherein said flywheel further includes a weight ring and ring gear located on the outer-most radius of said flywheel and said weight ring and said ring gear are located substantially on a side of said flywheel nearest to said face of said engine housing.

14. An ignition arrangement of claim 9 further comprising at least one rigid mounting member removably attached to said face of said engine housing at least partially encasing said timing pulley, and at lest partially covered by said flywheel.

15. An ignition arrangement of claim 14 wherein said at least one mounting member further includes a mounting area for mounting said charging coil and a second mounting area for mounting said pulser coil.

16. An ignition arrangement of claim 15 wherein said pulser coil being located closer to said face than said charging coil.

17. An ignition arrangement for an internal combustion engine having an output shaft supported for rotation about an axis, an engine housing at least partially enclosing said output shaft, said engine housing including at least one face, said output shaft having a portion extending through said one face of said engine housing and surrounded by said face, a drive pulley associated with said output shaft for driving an engine accessory, a fastener detachably connected to said output shaft for axially fixing said drive pulley to said output shaft, a timing wheel affixed for rotation with said drive pulley, and a pulser coil fixed relative to said engine housing and cooperating with said timing wheel for providing an engine output shaft position signal to an engine control.

18. An ignition arrangement of claim 17 wherein the timing wheel is held in abutment with a shoulder on the output shaft by the fastener.

19. An ignition arrangement of claim 17 wherein the timing wheel is held between the drive pulley and the engine housing face by the fastener.

20. An ignition arrangement of claim 19 wherein the timing wheel is held in abutment with a shoulder on the output shaft by the fastener.

21. An ignition arrangement of claim 17 further including a flywheel affixed to the output shaft on a side of the drive pulley opposite the timing wheel.

* * * * *